US005992776A

United States Patent [19]

Arcaini et al.

[11] Patent Number: 5,992,776

[45] Date of Patent: Nov. 30, 1999

[54] PROCESS FOR PROCESSING ASH

[75] Inventors: Gianni B. Arcaini, Jacksonville; Gary M. Carraux, Ponte Vedra Bch.; William R. Gibbes, Neptune Beach, all of Fla.

[73] Assignee: Duosengineering (USA), Inc., Jacksonville, Fla.

[21] Appl. No.: 08/686,765

[22] Filed: Jul. 26, 1996

[51] Int. Cl.[6] ..... B02C 19/12

[52] U.S. Cl. ..... 241/77; 241/79.1

[58] Field of Search ..... 241/19, 20, 24.1, 241/24.14, 24.25, 34, 48, 77, 79.1, 152.2, 186.2, DIG. 38

[56] References Cited

U.S. PATENT DOCUMENTS

| | | | |
|---|---|---|---|
| 455,802 | 7/1891 | Stanley et al. | 241/DIG. 38 |
| 3,765,612 | 10/1973 | Wenger | 241/34 |
| 3,817,458 | 6/1974 | Gilberto | 241/DIG. 38 |
| 4,874,134 | 10/1989 | Wiens | 241/79.1 |
| 4,900,330 | 2/1990 | Shoji et al. | 241/34 |
| 5,067,659 | 11/1991 | Heeren et al. | 241/24.14 |
| 5,174,509 | 12/1992 | Starke et al. | 241/DIG. 38 |
| 5,356,082 | 10/1994 | Prinz et al. | 241/24.14 |

OTHER PUBLICATIONS

Tennessee Department of Environment and Conservation by Permit Rule for Recovery of Fe and NFe Metals.

Tennessee Department of Environment and Conservation by Permit Rule for Beneficial Reuse of MSW Ash.

Metro Health Department—Air Permit i. Construction Permit; ii. Temporary Operating Permit.

Tennessee Department of Environment and Conservation Wastewater Pump/Haul Permit.

American Ash Recycling Corporation—Brochure on Company.

Miscellaneous Documents Author: Jan M. Barnes, "A Process For Resolving Ash Issues", *Solid Waste Technologies*, Sep./Oct. 1995 v. 9 #5.

"The WES–PHix Process" (N.D.) Wheelabrator Environmental Systems, Inc.

Author: Michael L. Hedges, "New Technology Addresses Challenge of MSW Ash Disposal", *Waste Dynamics of the Northeast*, Sep. 1994.

Author: Richard W. Goodwin, "Defending the Character of Ash", *Solid Waste 6 Power*, Sep./Oct. 1992.

Author: Jonathan V. L. Kiser, "Recycling and WTE: Working Well Together" Reprint from *Solid Waste 6 Power Industry Sourcebook 1993*.

Author: Warren H. Chesner, "Working Towards Beneficial Use of Waste Combustor Ash", *Solid Waste and Power*, Sep./Oct. 1993.

*Primary Examiner*—Mark Rosenbaum

*Attorney, Agent, or Firm*—Arthur G. Yeager

[57] ABSTRACT

An improved process for processing ash resulting from the mass burning of municipal waste includes a shear-force shredder for the size reduction of bulky items, impact cleaning of ferrous metal items, and a rotary washer for cleaning non-ferrous metals. Further improvements include sending the ash through an air separation unit to remove paper, wood, plastic and other unburned debris before providing ash to an eddy current separator for non-ferrous metal removal. The resultant ash which is essentially free of ferrous metals and non-ferrous metals, unburned material and unshreddables is then treated to immobilize certain heavy metals thus creating treated ash aggregate (TAA). Ash is recycled through a closed loop in the process to increase removal efficiency of metals and the homogeneous nature of the recovered (TAA).

25 Claims, 11 Drawing Sheets

131
WEIGHBIN
200
ALUMINUM BUNKER
TO 21
CLEAN ALUMINUM
130
COINS
COPPER
129
230
PICKING CONVEYOR
128
220
63

126
127
210
SIZED AGGREGATE
FROM 300
124
BRASS
RETURN TO MARTINTAG TANK
AGGITATE
123
60
62
FROM 300
122
125
139
SLURRY (COLLECTION PIT) FROM 120
121

PROCESS FOR PROCESSING ASH

BACKGROUND OF THE INVENTION

1. Field of the Invention

The present invention relates to a process of recycling ash and other combustion process residue from a municipal waste combustor (MWC) and particular to improvements in the process for handling and removing both ferrous and non-ferrous metals and unburned material.

2. Prior Art

American Ash Recycling Corporation of Tennessee currently operates an ash recycling plant in Nashville, Tennessee. Detailed information regarding this facility is provided in the Appendix. The present invention is directed towards an improved efficiency handling process to provide for lower operating costs, lower capital costs, higher recovery efficiency rates, higher level of control of recoverable materials such as metals, better recovery of unburned material and better quality of treated ash aggregate than in the prior art facility.

SUMMARY OF THE INVENTION

In one aspect of the present invention there is provided a system for the processing and recovery of material contained in an input ash stream from a municipal waste mass burn incinerator including sorting means for sorting material in the ash stream by size into a first and second faction, the first faction including material of a first size of three inches or greater, the second faction including material smaller than the first size, the improvement comprising size reduction means for comminuting material in the ash stream in the first faction to a size less than the first size and thereafter adding the first faction to the second faction for further processing and recovery. The means for size reduction includes a shredder for cutting material into a predetermined size as established by the shredder.

In a system that includes the separation of non-ferrous metals from the ash stream before separation of unburned material from the ash stream, there is provided the improvement comprising separating non-ferrous metals from the ash stream after separating unburned material from the ash stream. Also included is the removal of aggregate grit from the ash stream before separating non-ferrous metals from the ash stream, and cleaning of the non-ferrous metal after aggregate grit removal.

Other improvements include impact hammer cleaning of ferrous metals contained in the ash stream after the separation of the ferrous metals from the ash stream. Also removal of substantially all of the ferrous metals in the ash stream and removal of the non-ferrous metals from the ash stream has been accomplished.

The invention includes the sequential steps of sorting material in the ash stream by size into a first and second faction, the first faction including material of a first size, the second faction including material smaller than the first size, removing material in the first faction from the ash stream, the material of the second faction remaining in the ash stream; removing ferrous metals from the ash stream; removing non-ferrous metals from the ash stream; removing unburned material from the ash stream, reducing the size of the material in the first faction and returning the reduced material to the ash stream. Also included is the step of altering the sequence of the process steps to provide removal of unburned material from the ash stream before the removal of the non-ferrous metals in the ash stream and comprising the process step of removing aggregate grit from the ash stream. The improvement also comprises the process step of providing hammermill cleaning of the ferrous metals removed and comprising the process step of providing a rotary washer cleaning of the non-ferrous metals.

In another aspect of the present invention there is provided a method for the processing and recovery of material contained in an input ash stream from municipal waste mass burn incinerator comprising the sequential steps of: sorting material in the ash stream by size into a first and second faction, the first faction including material of a first size, the second faction including material smaller than the first size; comminuting material in the ash stream to a size less than the first size and thereafter adding the first faction to the second faction of the ash stream; removing ferrous metals from the ash stream; removing unburned material from the ash stream; and removing non-ferrous metals from the ash stream. Also included are the steps of removing substantially all the ferrous material from the ash stream before beginning the removal of non-ferrous material and removing aggregate grit from the ash stream. Also included is the step of returning the material in the ash stream that remains after the step of separating non-ferrous metals from the ash stream to the ash stream at a point in the process before the step of removing unburned material from the ash stream. The invention also included the steps of measuring the moisture content of the ash stream and the steps of controlling the rate of flow of material in the process based upon that measurement. There is also provided the step of removing ash from the ash stream after the removal of ferrous metals from the ash stream and returning material remaining in the ash stream after removal of the non-ferrous material to a point in the process before the removal of ferrous material and the removal of ash to increase the removal of ferrous materials remaining in the returned ash and to process such ash.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

INTRODUCTION

The present invention includes improved processes for the processing and recycling of ash and other combustion process residues provided as an output from a mass burn municipal waste combustor (MWC) that receives municipal solid waste inputs from regional waste sheds. The following description is an illustration of the basic process technology of the present invention. This will be followed by a more detailed discussion of the improvements according to the present invention.

The MWC ash is delivered to the material staging area located inside the site building. The feed material is conveyed to initial screening which separates the combined ash into multiple size gradations for further processing. Based on experience, the typical MWC ash stream from a mass-burn facility consists of 10–12% ferrous metals, 0.5–1.5% recoverable non-ferrous metals including aluminum, copper, brass and coins, 2–8% unburned materials, and residual ash material. The process recovers over 95% ferrous and non-ferrous metals and incorporates a patented, multi-chamber air classifier for the removal of unburned material which typically consist of paper, plastic and wood fragments. Unburned materials are returned to the generating MWC for recombustion.

The coarse element of the initial screening is directed through a ferrous metals magnetic separation process. Recovered ferrous metals are directed to a ferrous cleaning process. The materials which pass through the ferrous metals separator are directed to a screen for further size reduction. Two size fractions emerge, one size fraction is treated to reduce leachability of metals and thus becomes a treated ash aggregate product. The other sized fraction is conveyed to the Windzifter unit, which is the preferred air separation unit to remove the unburned combustibles such as paper, plastic and wood from the ash stream. The remaining ash is then crushed and screened. The recovered unburned coarse material is conveyed to a storage bin for return to the MWC. The remaining material is conveyed to the non-ferrous separating process where the non-ferrous metal is cleaned and segregated into copper, brass, coins and aluminum streams.

The process uses the patented "WES-PHix" (U.S. Pat. No. 4,737,356) process which has been demonstrated to reduce the leachability of metals from MWC ash. The "WES-PHix" process reduces metal solubility and availability through a patented chemical reaction. The "WES-PHix" process uses a primary agent consisting of a dilute water soluble phosphate solution. The amount of water soluble phosphate to be added to the ash residue is dependent on characteristics such as the alkalinity of the ash residue and the ash buffering capability. The "WES-PHix" immobilization technology reduces the potential leachability of trace metals that may be found in ash residue.

Figure 1A:
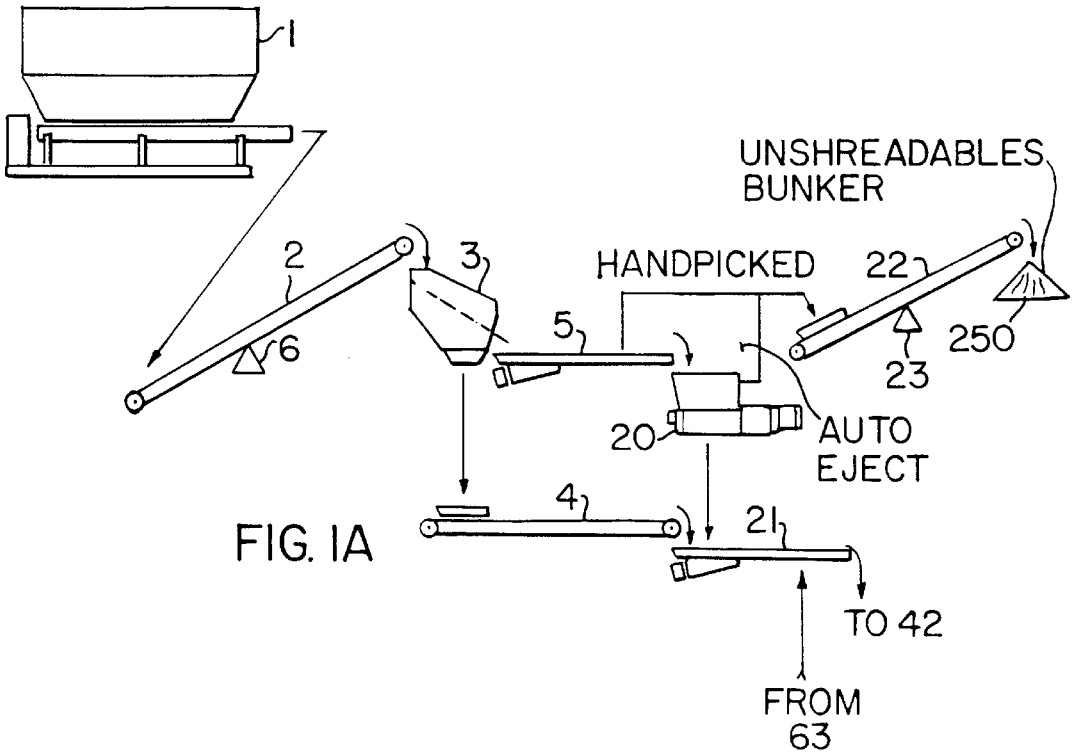
FIGS. 1, 2 and 3 are process flow charts of the process system and associated apparatus in accord with the present invention.
Figure 1B:
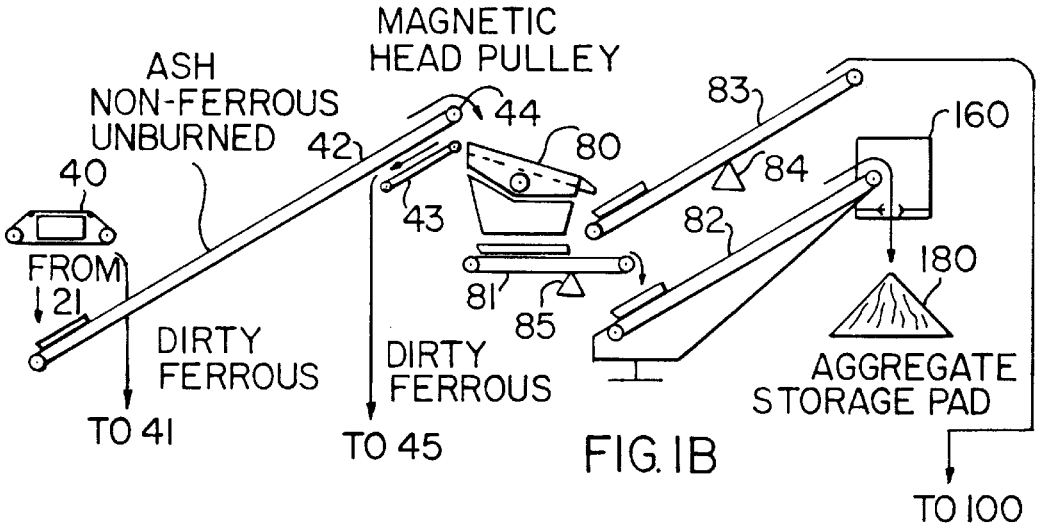
Figure 2A:
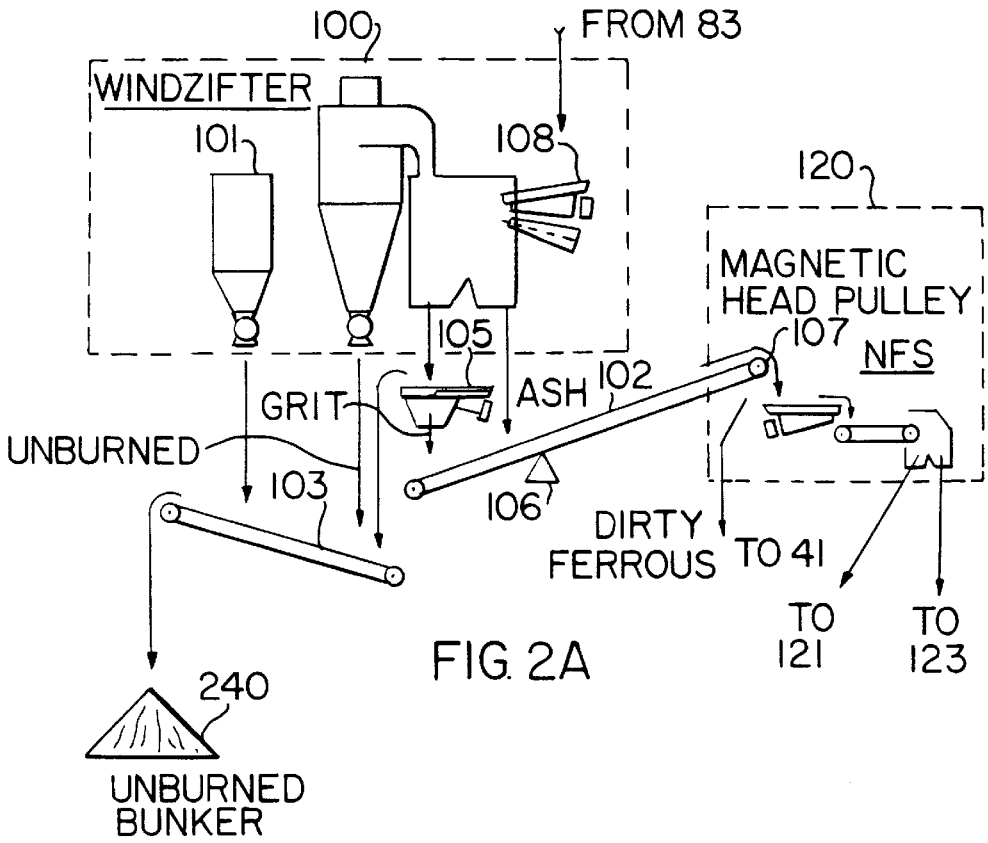
Figure 2B:
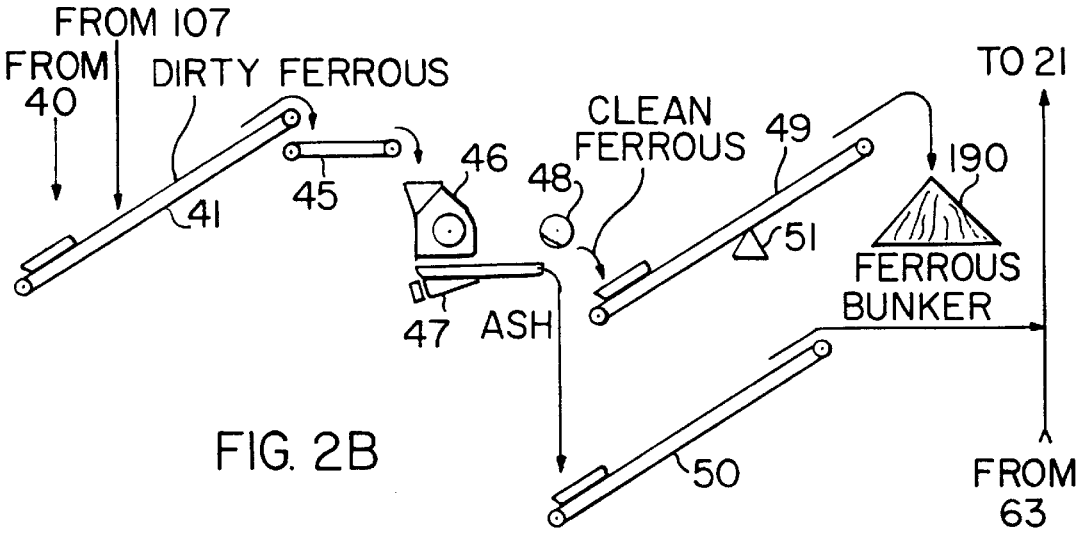
Figure 2C:
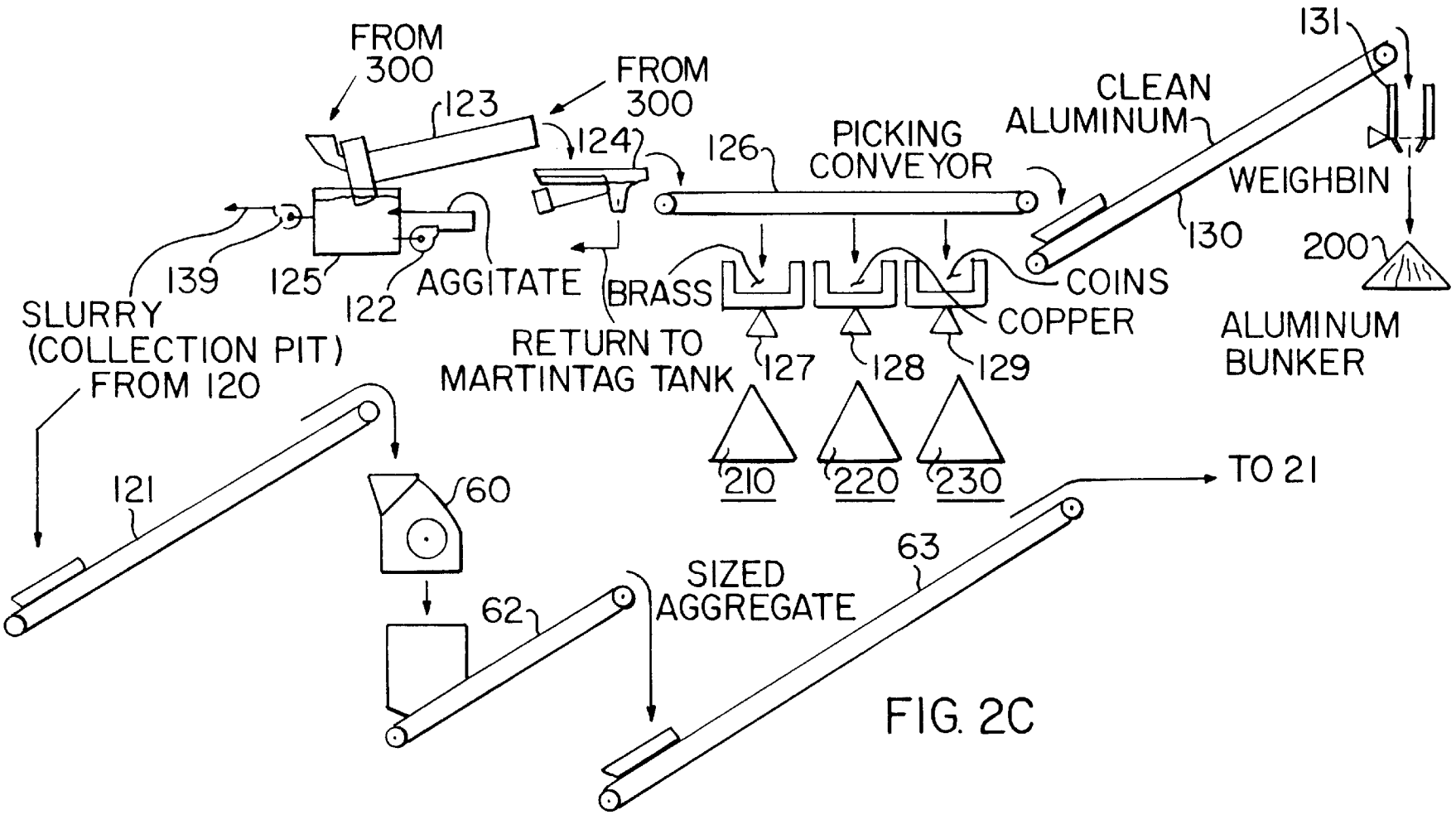

With reference now to the drawings the processing facility is illustrated at 10 in the process flow diagrams of FIGS. 1 and 2. Input feeder 1 receives ash (MWC) from the mass burn source. Input feeder 1 includes a conveying mechanism that is controlled by a variable frequency drive that varies the vibration frequency in response to detected ash moisture levels at input feeder 1 or at conveyor 81. The output of feeder 1 is to a belt conveyor 2 that is monitored by an input belt loading scale 6 that provides an output to the process controller for control of the variable frequency drive of input feeder 1. Ash moisture levels are measured and the resultant data entered into system process controller 400.

The output of conveyor 2 is provided to a vibro-bar sizer that sorts debris into components larger and smaller than 3". Material having a size of less than 3" is directed to belt conveyor 4 which provides an output to a vibrating pan conveyor 21. Material having a size greater than 3" is directed to rotary shear shredder 20.

The present invention employs a hammermill impactor to clean ferrous metals as will be discussed hereinbelow. Materials such as refrigeration compressors and bed springs are representative of the materials that may be found in MWC ash output. The present invention employs an improved size reduction process in the form of an adjustable low-speed, high torque rotary shear shredder 20 to handle material over 3" in size. Metal objects which cannot be shredded are hand picked from shredder picking pan conveyor 5. Other material is directed to shredder 20 which includes operating controls for auto-eject of materials such as hardened metal that may exceed the shredder's capability. Various safety features such as enclosures and sensors are also employed with shredder 20. The output of shredder 20 is to the conveyor 21.

Material that is unshreddable is directed via shredder auto-eject conveyor 22 to a storage pile. Belt scale 23 provides weight information to process control.

Material now sized to less than 3" is placed on a belt conveyor 42 which is subjected to magnetic separation of ferrous metals via electromagnet 40. Ferrous metals thus separated are directed to belt conveyor 41. The remaining material on belt 42 includes ash, non-ferrous metals and unburned debris. Any remaining ferrous material will be picked up by magnetic head pulley 44 and directed to belt conveyor 45 via belt 43.

The use of ferrous metal cleaning hammermill 46 is an improvement over the process of the prior art. The improved cleaning process will decrease operating costs and enhance the economic value of the ferrous material being removed and enhance the removal of ash that would otherwise be carried with the metal. Hammermill 46 outputs to vibrating feeder 47 for further magnetic separation via drum electromagnet 48. The ferrous metals are placed on belt conveyor 49 which includes ferrous product belt scale 51. The ferrous material is stored at 190. Ash from feeder 47 is placed on belt conveyor 50 to be reintroduced for processing via 21.

With reference to conveyor 42, the ash, non-ferrous metals, and unburned material is sent to a flexible membrane fine screen separator 80 that separates material into two sizes: (1) material <⅜" and (2) material >⅜" to <3". Belt conveyor 81 transports material of less than ⅜" to belt conveyor 82 over aggregate product scale 85 which measures the weight of the material. The weight information is utilized as a means of measuring the amount of WES-PHix treatment to be applied, as discussed below, as well as a means of measuring the amount of treated ash aggregate produced.

The WES-PHix system 160 is a patented stabilization process used to "fix" residual heavy metal such as lead and cadmium to the ash aggregate. The treatment solution is sprayed onto the aggregate which is collected at 180 thus creating treated ash aggregate which is a marketable product. The 6500 gallon treatment solution tank 161 includes pumps 162 and 163 and various conventional monitoring equipment.

Figure 3:
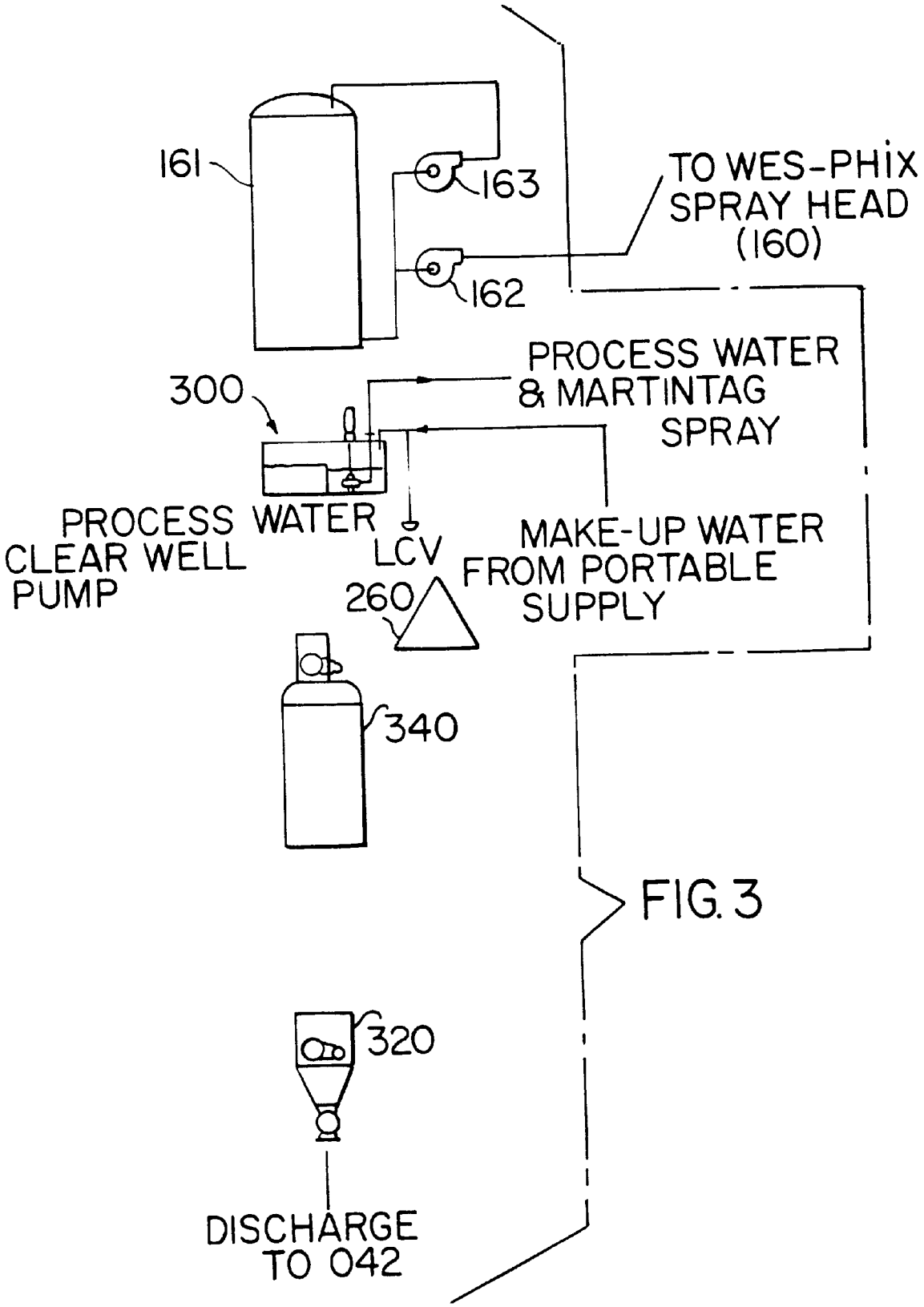
Figure 4:
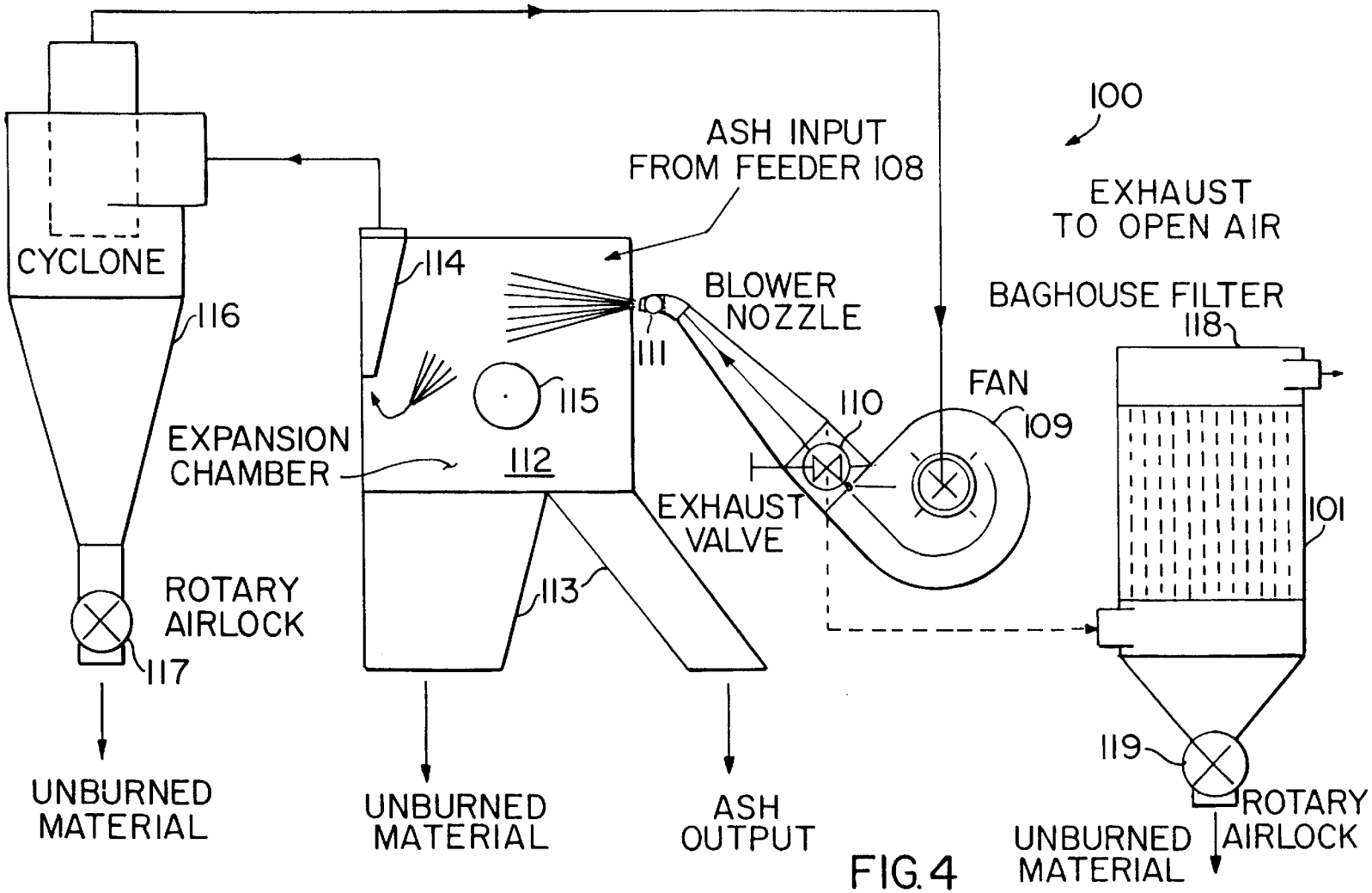
FIG. 4 is a pictorial diagram of the air separation unit employed in the present invention.

Material from screen 80 is directed to belt conveyor 83 over inner loop belt scale 84 to the Windzifter unit 100, which includes a baghouse 101. The unit 100 is a cyclone separator and expansion chamber illustrated in pictorial form in FIG. 3. The Windzifter unit 100 was developed to remove unburned materials (paper, fabrics, wood, plastics and other unburned combustibles) from the ash stream of municipal waste combustors. Ash containing unburned materials enters the unit 100 via a vibrating pan feeder 108. As the ash is spread evenly across the pan 108 moving toward the separation chamber 112, it drops from the end of the pan 108 into a stream of low pressure, high volume air generated by a fan or blower 109. The force and volume of the air is regulated by an adjustable nozzle 111 which distributes the air across the width of the ash stream. Since the ash stream is falling evenly across the airstream, the lighter materials are blown away from the heavier ash and subsequently physically directed into separate chutes 113 below. The air nozzle 111 is positioned to blow in the direction of ash flow to maximize the separation efficiency by not changing the directional flow of the ash stream. Located at the top of the chutes 113 is a rotating drum 115 which serves as a divider for materials which fall between the light and heavy fractions. Any materials which fall onto the drum 115 will be directed to the unburned chute to belt 103 due to the rotation of the drum 115. The air next goes to a cyclone separator 116 via outlet 114 which is used for fine unburned particle separation. Upon leaving the cyclone 116, the air stream flows to either the air pollution control device, baghouse 101, or as a source of air for the blower 109. Air pollution control is achieved via a baghouse filter 118. The two air streams are provided through a "Y" air duct intersection located upstream of damper valve 110 at the blower 109 discharge. One stream is for the baghouse filter 118 while the other stream is the source of air for the blower nozzle 111. Unburned materials from the separation chamber 112 are screened for fine grit removal at screen 105 before being joined with the unburned materials discharged via airlock 117 from the cyclone separator 116 and baghouse 101 via airlock 119.

The improved process of the present invention is the use of the Windzifter unit 100 before non-ferrous metal handling at separator 120. The unit 100 provides an output of unburned material such as paper, wood fragments and plastic to belt conveyor 103 where it is collected at 240. Unit 100 also provides an output to unburned material grit screen 105 where non-ferrous metals and ash are directed to belt conveyor 102 and weighed at scale 106 for transport to eddy current separator 120 via additional magnetic pulley separator 107 which provide ferrous metals to belt 41. Non-ferrous materials separated at separator 120 are sent to the rotary washer 123. The use of unit 100 before separator 120 greatly reduces the feed rate and burden depth on the separator 120 and improves the separation efficiency. The additional step of grit removal at screen 105 and ferrous metal removal at magnet 107 are also improvements over the prior art and further enhance efficiency.

Figure 5:
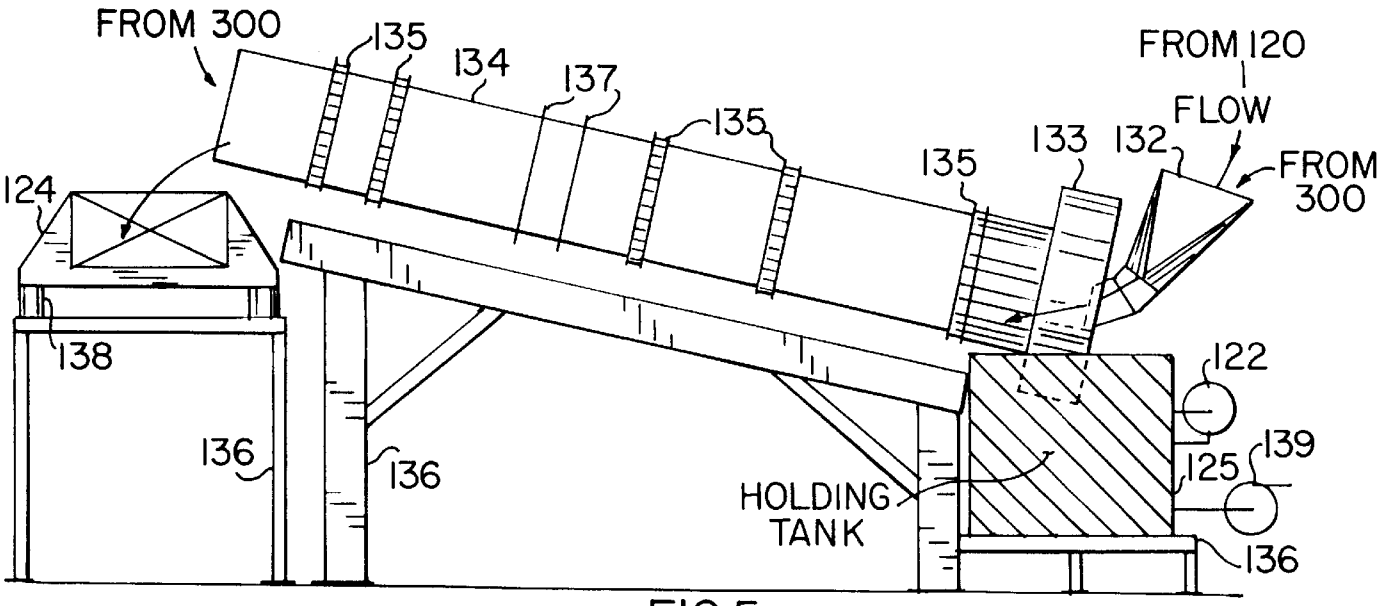
FIG. 5 is a pictorial diagram of the non-ferrous metals cleaning system employed in the present invention.

The MartinTag Non-Ferrous Cleaner 123 cleans the non-ferrous metals extracted from Municipal Waste Combustor (MWC) ash to enhance the separation of brass, copper coins and aluminum metals. The system, illustrated pictorially in FIG. 5, incorporates a rotating washer drum 133 bolted to a helix feed drum 134. Non-ferrous metals are loaded by a chute 132 entering the rotating center of the washer drum 133. Water from the clear well at 300 is also introduced in this chute 132 to provide the cleaning water necessary for the washer action. Clear well water from 300 is also sprayed into the open end of the helix feed drum 134 to aid in downwashing any debris back to the washer drum 133. The drums 133, 134 rotate on idler rollers 135 mounted in saddles (not shown) and indexed to track risers 137 affixed to the helix drum 134 via frame members 136. The drums 133, 134 are rotated by transmission of torque from a gear motor (not shown) through a rubber tire (not shown) in contact with the helix drum 134 as understood in the art. The rotational speed of drum 133 is approximately 22 RPM. A slurry tank 125 is located below the washer drum 133 to collect and manage the washed debris discharged from the washer drum 133. A pump 122 in the slurry tank 125 provides agitation to the cleaning water thus preventing any solids from settling in the tank 125. A second pump 139, activated by a level switch (not shown), inhibits overflow of tank 125 by discharging the slurry to the clear well settling pits located at 300. As metals accumulate in the washer drum 133, paddles (not shown) in the washer drum 133 cause metals to eventually seek the spiral, worm or helix (not shown) inside the helix feed drum 134. The helix drum transfers the cleaned metals to a dewatering screen 124 and eventually to the non-ferrous picking belt 126. Frames 136 are standard members. Water from screen tank 138 is returned to water tank 125.

Non-ferrous material from screen 105 and unit 100 is directed to a non-ferrous cleaning washer system 123 and dewatering screen 124. The non-ferrous material is subsequently directed to a slow-moving picking conveyor 126 where the material is sorted as brass, copper and coins in weigh bins 127, 128 and 129 and stored at locations indicated by numbers 210, 220, and 230 respectively. Other non-ferrous material such as aluminum is directed to non-ferrous product conveyor 130 and from there to weigh bin 131 and storage at 200.

Ash removed at separator 120 is collected at conveyor 121, and conveyed to the aggregate sizing hammermill 60 and is further directed to belt conveyors 62 and 63 where it is returned to vibrating pan conveyor 21 to provide a closed loop to increase removal efficiency of the overall process. Unburned material at 240 will be returned to the MWC. The resulting treated ash aggregate at 180 will be used as a virgin aggregate replacement building product material and, because of the looping and additional ferrous metal removal at magnet 107, the material will be substantially homogeneous in nature. The loop is monitored via inter-loop scale 84.

Other components of the system include vacuum system 320 which outputs to belt 42, process water collection and recirculating system 300, a scale 260 for weighing trucks and compressed air system 340.

Figure 6:
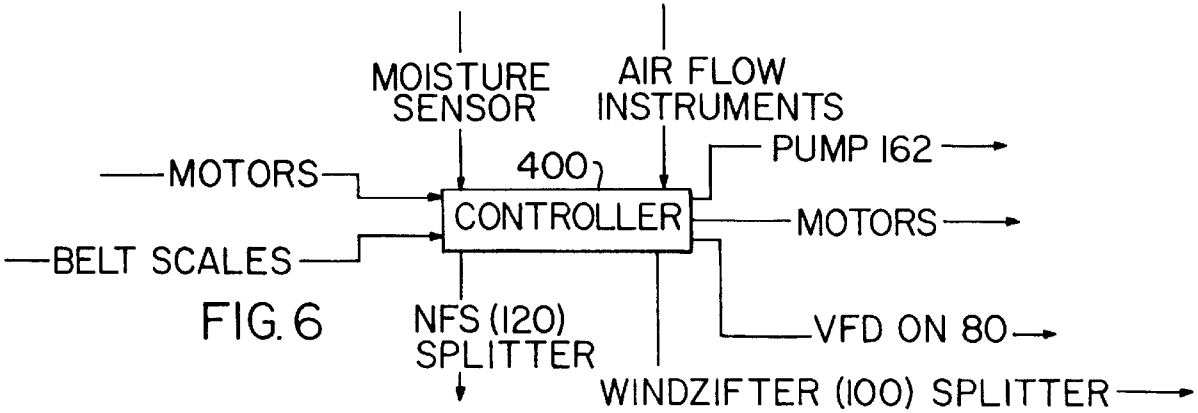
FIG. 6 is a simplified block diagram of the process controller employed in the present invention.

FIG. 6 is a simplified block diagram of the system controller 400, a standard computer-based process control system as understood in the art. The controller 400 receives data from the various measuring devices and sensors located throughout the recycling system. As mentioned hereinabove, the input labeled "moisture sensor" is preferably an automatic data entry terminal but may be done manually. The controller 400 may control the variable frequency drive (VFD) on screen 80 and the vibration frequency of input feeder 1 as desired. Feeder scale 6, aggregate scale 85 and inter-loop belt scale 84 provide data to assist in measuring and controlling the flow rate through the process.

For the reader's convenience, Table 1 identifies the major system components by way of the numbers used herein.

Figure 7A:
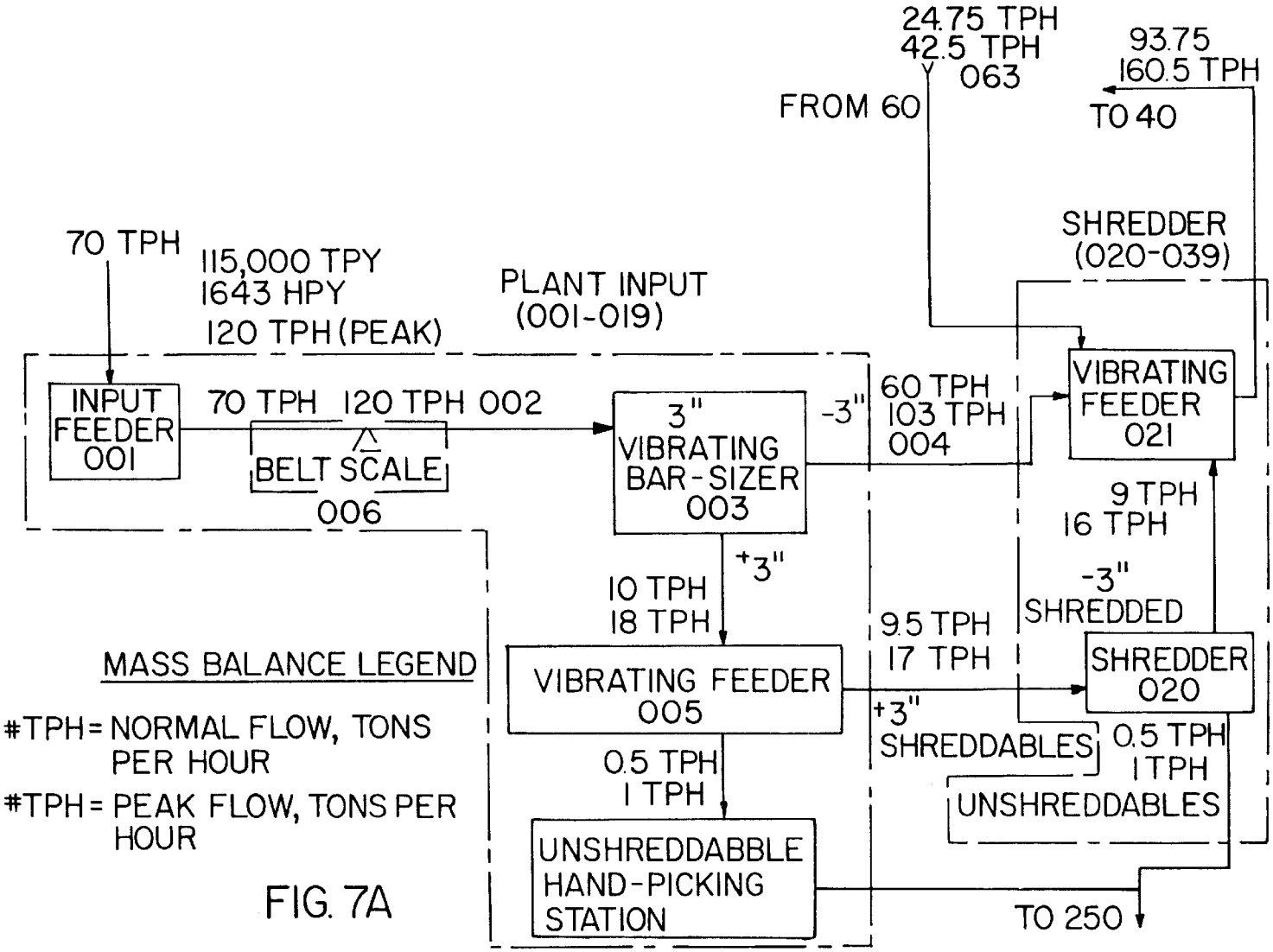
FIGS. 7–8 are process mass balance diagrams for the process system according to the present invention.
Figure 7B:
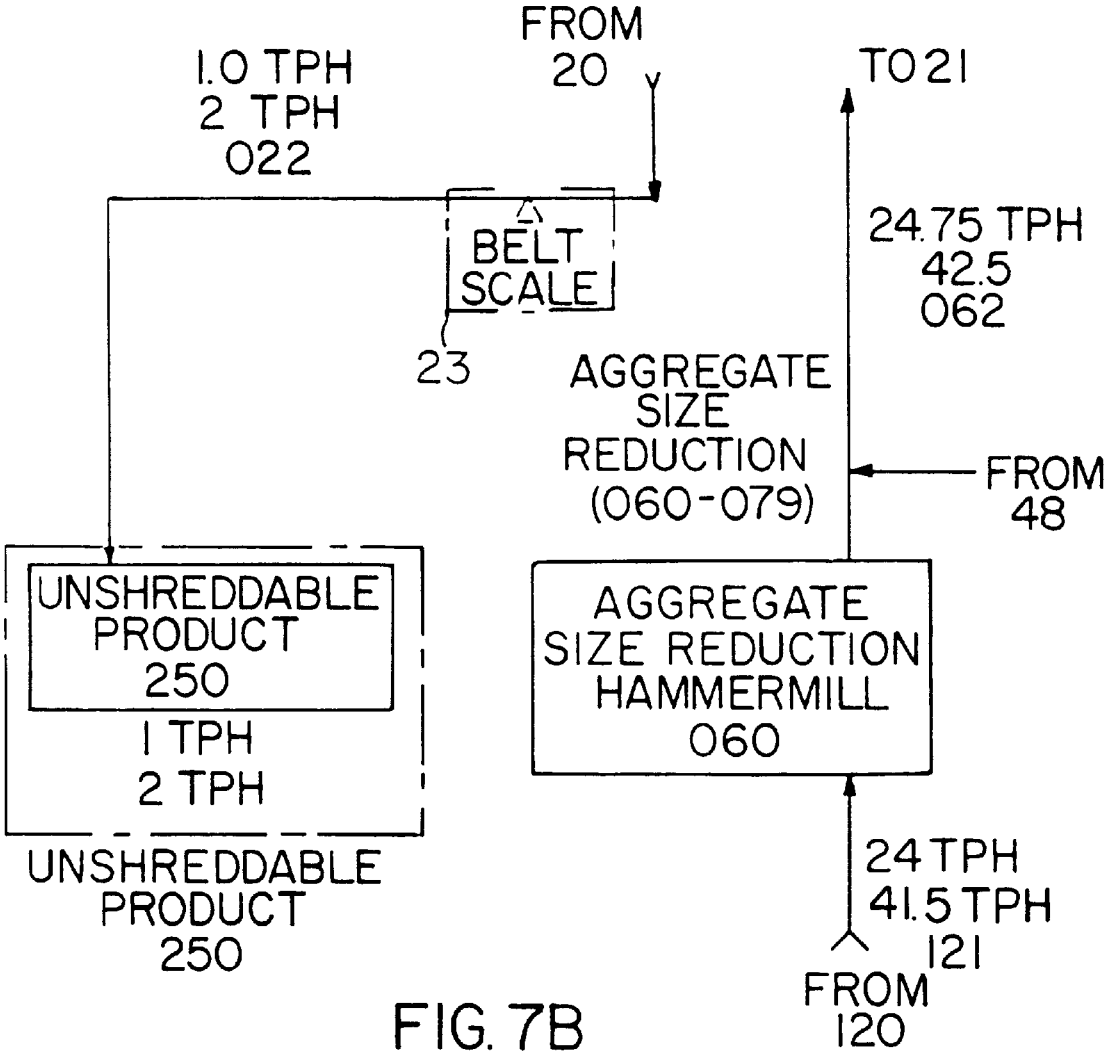
Figure 8A:
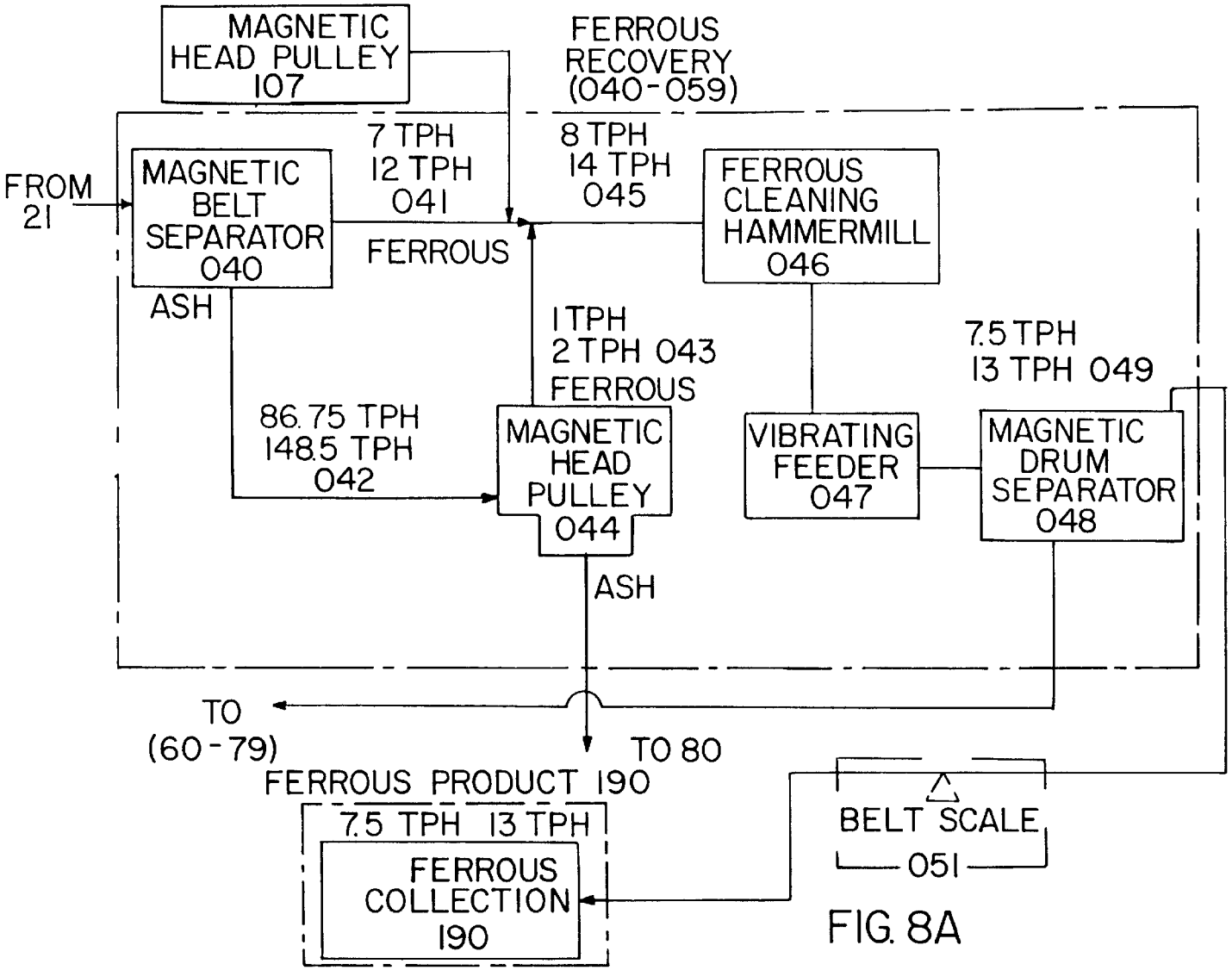
Figure 8B:
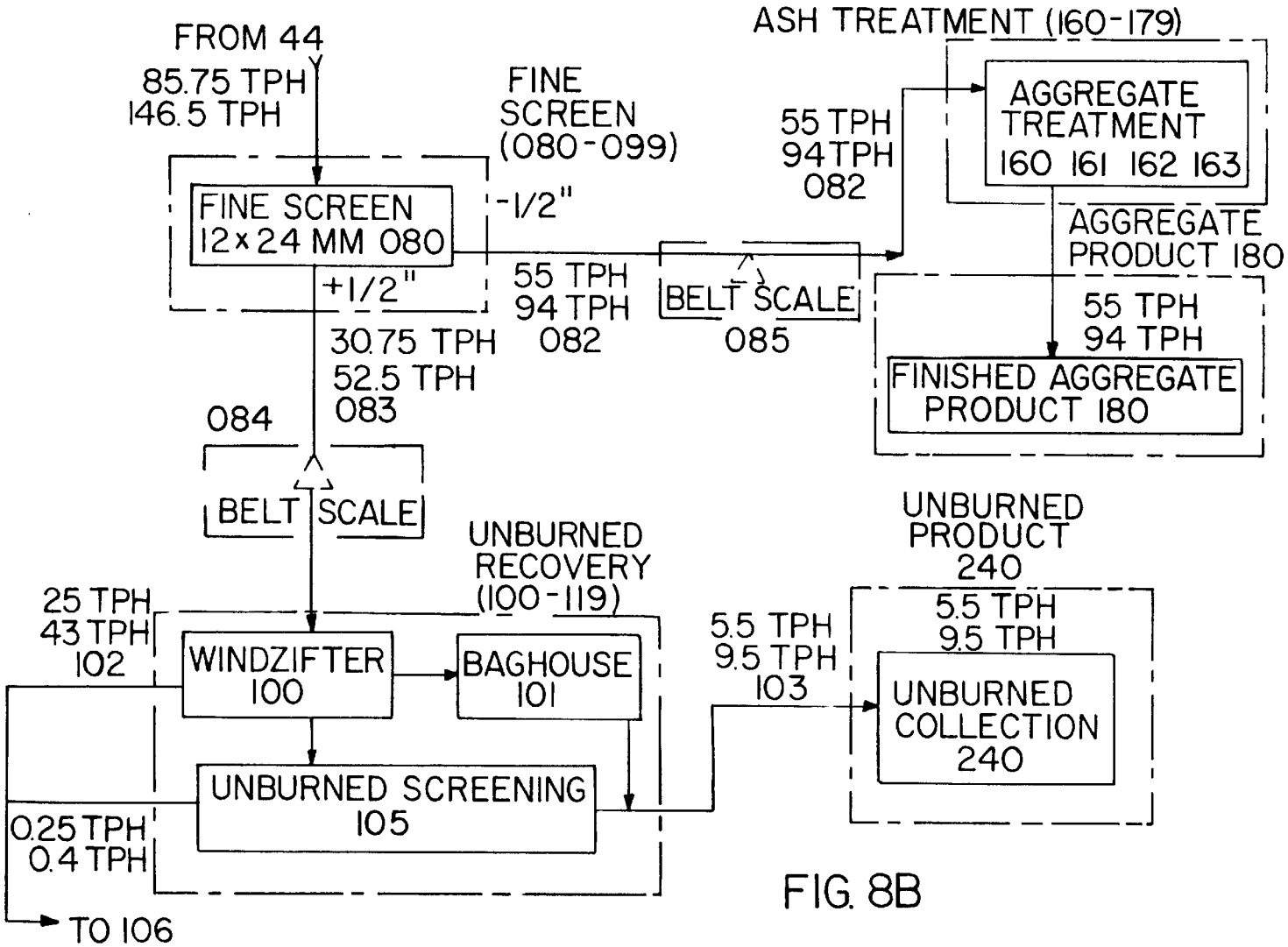
Figure 8C:
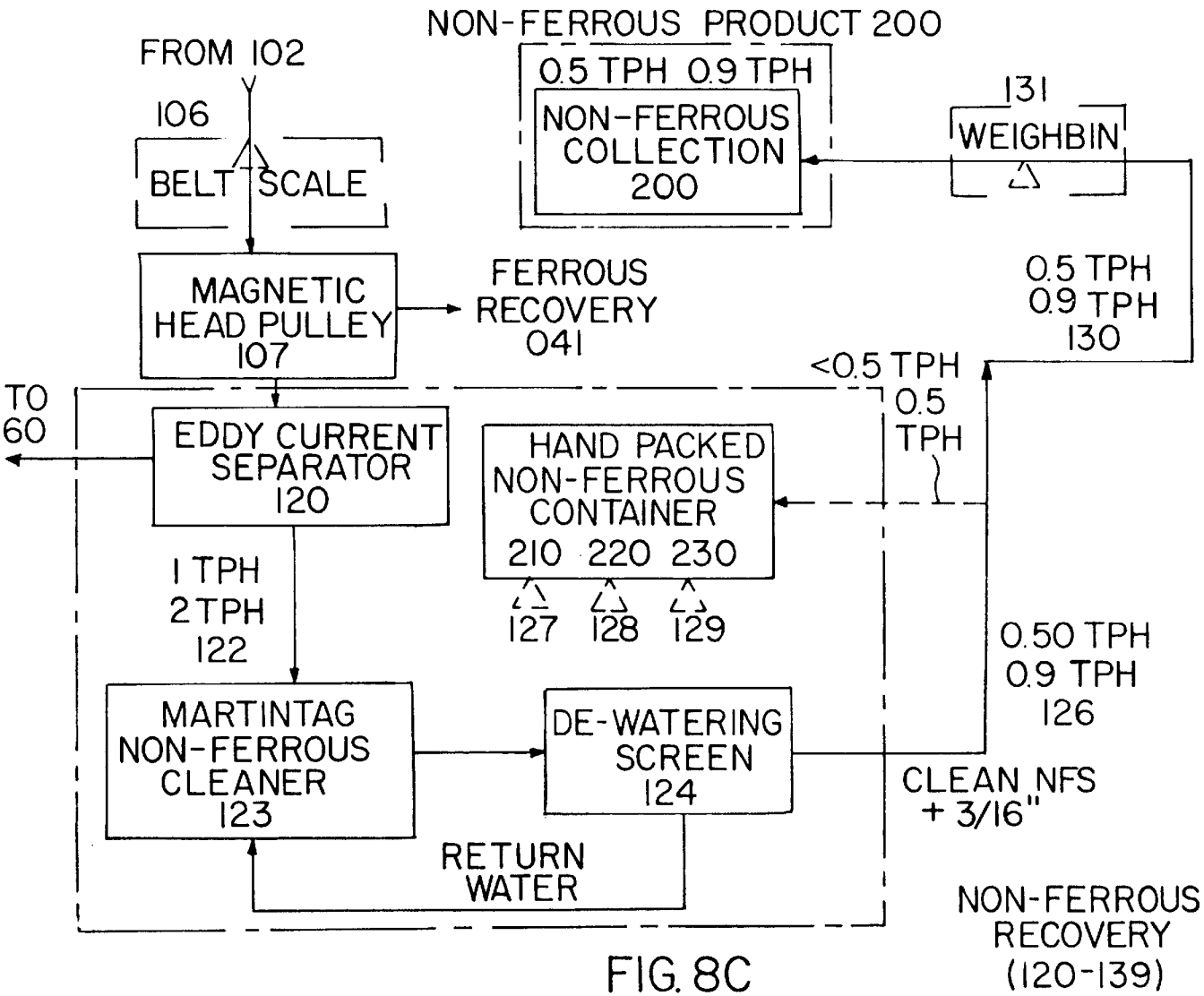

FIGS. 7–8 are process mass balance diagrams of the ash processing system illustrating the various flows within the system as well as output quantities.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

TABLE 1

| ITEM | DESCRIPTION | ITEM | DESCRIPTION |
|---|---|---|---|
| 1 | INPUT FEEDER | | |
| 2 | BELT CONVEYOR | 114 | OUTPUT CHUTE |
| 3 | VIBRO-BAR SIZER | 115 | CHAMBER DRUM |
| 4 | BELT CONVEYOR | 116 | CYCLONE |

TABLE 1-continued

| ITEM | DESCRIPTION | ITEM | DESCRIPTION |
|---|---|---|---|
| 5 | SHREDDER PICKING PAN CONVEYOR | 117 | CYCLONE AIRLOCK |
| 6 | INPUT LOADING BELT SCALE | 118 | BAGHOUSE FILTER |
| 20 | SHREDDER | 119 | BAGHOUSE AIRLOCK |
| 21 | VIBRATING PAN CONVEYOR | 120 | EDDY CURRENT SEPARATOR |
| 22 | SHREDDER AUTO-EJECT CONVEYOR | 121 | BELT CONVEYOR |
| 23 | UNSHREDDABLES BELT SCALE | 122 | MARTINTAG AGGITATION PUMP |
| 40 | BELT ELECTROMAGNET | 123 | MARTINTAG NON-FERROUS WASHER |
| 41 | BELT CONVEYOR | 124 | DEWATERING SCREEN |
| 42 | BELT CONVEYOR | 125 | MARTINTAG TANK |
| 43 | BELT CONVEYOR | 126 | NFe PICKING CONVEYOR |
| 44 | MAGNETIC HEAD PULLEY | 127 | BRASS PRODUCT PLATFORM SCALE |
| 45 | BELT CONVEYOR | 128 | COPPER PRODUCT PLATFORM SCALE |
| 46 | FERROUS CLEANING HAMMERMILL | 129 | COINS PRODUCT BENCH SCALE |
| 47 | VIBRATING FEEDER | 130 | ALUMINUM PRODUCT CONVEYOR |
| 48 | DRUM ELECTROMAGNET | 131 | ALUMINUM PRODUCT WEIGH HOPPER |
| 49 | BELT CONVEYOR | 132 | INPUT CHUTE |
| 50 | BELT CONVEYOR | 133 | WASHER DRUM |
| 51 | FERROUS PRODUCT BELT SCALE | 134 | HELIX DRUM |
| 60 | AGGREGATE SIZING HAMMERMILL | 135 | IDLERS |
| 62 | BELT CONVEYOR | 136 | FRAMES |
| 63 | BELT CONVEYOR | 137 | DRUM RISERS |
| 80 | FINE SCREEN (BIVITECH) | 138 | DEWATERING TANK |
| 81 | BELT CONVEYOR | 139 | SLURRY PUMP |
| 82 | STACKING CONVEYOR | 160 | WES-PHix SPRAY HEAD |
| 83 | BELT CONVEYOR | 161 | WES-PHix SOLUTION STORAGE TANK |
| 84 | INNER-LOOP BELT SCALE | 162 | WES-PHix SPRAY PUMP |
| 85 | AGGREGATE PRODUCT BELT SCALE | 163 | WES-PHix RECIRCULATION PUMP |
| 100 | WINDZIFTER UNIT | 180 | AGGREGATE PRODUCT |
| 101 | WINDZIFTER BAGHOUSE | 190 | FERROUS PRODUCT |
| 102 | BELT CONVEYOR | 200 | ALUMINUM PRODUCT |
| 103 | BELT CONVEYOR | 210 | BRASS PRODUCT CONTAINER |
| 105 | UNBURNED GRIT SCREEN | 220 | COPPER PRODUCT CONTAINER |
| 106 | NFS FEED BELT SCALE | 230 | COIN PRODUCT CONTAINER |
| 107 | MAGNETIC HEAD PULLEY | 240 | UNBURNED PRODUCT |
| 108 | PAN FEEDER | 250 | UNSHREDDABLE PRODUCT |
| 109 | FAN | 260 | TRUCK SCALE |
| 110 | EXHAUST VALVE | 300 | PROCESS WATER PUMP |
| 111 | BLOWER NOZZLE | 320 | HVAC SYSTEM |
| 112 | CHAMBER | 340 | PLANT COMPRESSED AIR |
| 113 | CHUTES | 400 | PROCESS CONTROLLER |

What is claimed as new and what it is desired to secure by Letters Patent of the United States is:

1. A system for the processing and recovery of material contained in an input ash stream from a municipal waste mass burn incinerator including sorting means for sorting material in the ash stream by size into a first and second portion prior to other processing and recovery apparatus, said first portion including material of a first size of three inches or greater, said second portion including material smaller than said first size, the improvement comprising size reduction means for comminuting material in the ash stream in said first portion from said sorting means to a size less than said first size, combining means for adding said first portion to said second portion and supplied downstream to the processing and recovery apparatus, said size reduction means being located before any ferrous separating means which in turn is located downstream of said combining means of the processing and recovery apparatus.

2. The system as defined in claim 1 wherein said means for size reduction includes a shredder for cutting material into a predetermined size as established by said shredder.

3. The system as defined in claim 1 further including means for measuring the moisture content of the ash stream and means for controlling the rate of flow of material in the process based upon the measurement from said means for measuring.

4. A system for the processing and recovery of material contained in an input ash stream from a municipal waste mass burn the improvement comprising means for separating non-ferrous metals from the ash stream and means for separating unburned material from the ash stream, said means for separating unburned material being located upstream from said means for separating non-ferrous metals.

5. The system as defined in claim 4 including means for separation of ferrous metals from the ash stream, and means for impact hammer cleaning of ferrous metals after said means for separation of said ferrous metals from the ash stream.

6. The system as defined in claim 4 further including means for removing aggregate grit from the ash stream before said means for separating non-ferrous metals from the ash stream.

7. The system as defined in claim 6 further comprising means for returning the material in the ash stream that remains after said means for separating non-ferrous metals from the ash stream to the ash stream at a point in the process before said means for removing unburned material from the ash stream.

8. The system as defined in claim 6 further including means for cleaning of said non-ferrous metal after said means for removing aggregate grit.

9. The system as defined in claim 4 further comprising means for returning the material in the ash stream that remains after said means for separating non-ferrous metals from the ash stream to the ash stream at a point in the process before said means for removing unburned material from the ash stream.

10. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; providing means for removing aggregate grit from the ash stream; means for removing non-ferrous metals from the ash stream located downstream of said means for removing aggregate grit;

means for removing unburned material from the ash stream located upstream of said means for removing non-ferrous metals.

11. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; means for removing ferrous metals from the ash stream; means for hammermill cleaning of ferrous metals located downstream of said means for removing ferrous metals; means for removing non-ferrous metals from the ash stream; and means for removing unburned material from the ash stream located upstream of said means for removing non-ferrous metals.

12. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; means for removing non-ferrous metals from the ash stream located downstream of said means for removing ferrous metals; and means for removing unburned material from the ash stream located upstream of said means for removing non-ferrous metals.

13. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; providing means for removing aggregate grit from the ash stream; means for removing non-ferrous metals from the ash stream located downstream of said means for removing aggregate grit; means for removing unburned material from the ash stream located upstream of said means for removing nonferrous metals, and further comprising means for returning material in the ash stream that remains after said means for removing aggregate grit located before said means for removing ferrous metals.

14. The system as defined in claim 13 further including means for removing ash from the ash stream being located downstream of said means for removing ferrous metals.

15. A system for the processing and recovery of material contained in an input ash stream from a municipal waste mass burn incinerator comprising means for sorting material in the ash stream by size into a first and second portion, said first portion including material smaller than said first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; providing means for removing aggregate grit from the ash stream; means for removing non-ferrous metals from the ash stream located downstream of said means for removing aggregate grit; means for removing unburned material from the ash stream located upstream of said means for removing non-ferrous metals, and further including means for measuring the moisture content of the ash stream; and means for controlling the rate of flow of material in the process based upon the results of the measurement of said means for measuring.

16. A system for processing and recovery of the material contained in an input ash stream from a municipal waste mass burn incinerator including means for separation of some of the non-ferrous metals from the ash stream, the improvement comprising means for cleaning of non-ferrous metals after said means for separation of said non-ferrous metals from the ash stream and means for removing unburned material located upstream of said means for removing non-ferrous metals.

17. A system for the processing and recovery of the material contained in an input ash stream from a municipal waste mass burn incinerator including means for removal of ferrous and non-ferrous metals from the ash stream, the improvement comprising means for removing substantially all of the ferrous metals in the ash stream before said means for removing non-ferrous metals from the ash stream and means for removing unburned material being located before said means for removing non-ferrous material.

18. The system as defined in claim 17 further including means for removing ash from the ash stream after said means for removal of ferrous metals from the ash stream.

19. The system as defined in claim 18 further including means for returning material remaining in the ash stream after said means for removal of the non-ferrous material to before said means for removal of ferrous material and said means for removal of ash to increase the removal of ferrous materials remaining in the returned ash.

20. A system for the processing and recovery of material contained in an input ash stream from a municipal waste mass burn incinerator including means for sorting material in the ash stream by size into a first and second portion, said first portion including material of a first size, said second portion including material smaller than said first size, said sorting means removing material in said first portion from the ash stream, said material of said second portion remaining in the ash stream; means for removing ferrous metals from the ash stream; means for removing non-ferrous metals from the ash stream; means for removing unburned material from the ash stream and means for reducing the size of the material in said first portion and returning said reduced material to the ash stream before said means for removing ferrous metals from the ash stream.

21. The system as defined in claim 20 further comprising means for returning the material in the ash stream that remains after said means for removing unburned material from the ash stream between said means for sorting and said means for removing ferrous metals.

22. The system as defined in claim 20 further comprising second means for removing ferrous metals from the ash stream, said second means being located in the ash stream after said means for removing unburned material.

23. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the resultant ash stream; means downstream of said means for reducing for removing ferrous metals from the resultant ash stream; means downstream of said means for removing ferrous metals for removing unburned material from the ash stream, means downstream from said means for removing unburned material for removing non-ferrous metals from the ash stream, said means for removing unburned material being located between said means for removing ferrous metals and said means for removing non-ferrous metals.

24. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; means for removing non-ferrous metals from the ash stream; means for rotary washing non-ferrous metals located downstream of said means for removing non-ferrous metals and means for removing unburned material from the ash stream located upstream of said means for removing non-ferrous metals.

25. A system for the processing and recovery of material contained in an input ash stream from a municipal waste mass burn incinerator comprising means for sorting material in the ash stream by size into a first and second portion, said first portion including material of a first size, said second portion including material smaller than said first size; means for reducing the size of the material in the first portion by comminuting material in the ash stream to a size less than said first size and thereafter adding said first portion to said second portion of the ash stream; means for removing ferrous metals from the ash stream; means for removing non-ferrous metals from the ash stream; means for removing unburned material from the ash stream being located upstream of the means for removing non-ferrous metals and means for removing aggregate grit from the ash stream before said means for removal of said non-ferrous metals from the ash stream.

* * * * *